US008911303B2

(12) United States Patent
Sakai et al.

(10) Patent No.: US 8,911,303 B2
(45) Date of Patent: Dec. 16, 2014

(54) GOLF CLUB HEAD AND METHOD FOR MANUFACTURING THE SAME

(71) Applicant: K.K. Endo Seisakusho, Tsubame (JP)

(72) Inventors: Tomoyuki Sakai, Tsubame (JP); Junichi Amano, Tsubame (JP); Masaru Kawauchi, Tsubame (JP)

(73) Assignee: K.K. Endo Seisakusho, Tsubame-shi (JP)

( * ) Notice: Subject to any disclaimer, the term of this patent is extended or adjusted under 35 U.S.C. 154(b) by 95 days.

(21) Appl. No.: 13/684,861

(22) Filed: Nov. 26, 2012

(65) Prior Publication Data

US 2013/0143690 A1 Jun. 6, 2013

(30) Foreign Application Priority Data

Nov. 25, 2011 (JP) ..... 2011-257083

(51) Int. Cl.

| | |
|---|---|
| ***A63B 53/04*** | (2006.01) |
| ***B21K 17/00*** | (2006.01) |
| ***B21J 5/06*** | (2006.01) |
| ***B21K 23/00*** | (2006.01) |

(52) U.S. Cl.

CPC ..... *A63B 53/047* (2013.01); *B21K 17/00* (2013.01); *B21J 5/06* (2013.01); *B21K 23/00* (2013.01)

USPC ..... 473/350; 72/352

(58) Field of Classification Search

USPC ..... 473/350; 72/352

See application file for complete search history.

(56) References Cited

U.S. PATENT DOCUMENTS

| | | | | |
|---|---|---|---|---|
| 5,026,520 | A * | 6/1991 | Bhowal et al. | 148/670 |
| 5,735,755 | A * | 4/1998 | Kobayashi | 473/342 |
| 2003/0109328 | A1 * | 6/2003 | Chen | 473/342 |

FOREIGN PATENT DOCUMENTS

| | | | |
|---|---|---|---|
| JP | 09-038252 | A | 2/1997 |
| JP | 10-108927 | A | 4/1998 |
| JP | 2004-141277 | A | 5/2004 |
| JP | 2005-319019 | A | 11/2005 |
| JP | 2008-125722 | A | 6/2008 |
| JP | 2009-261908 | A | 11/2009 |

* cited by examiner

*Primary Examiner* — Michael Dennis

(74) *Attorney, Agent, or Firm* — Westerman, Hattori, Daniels & Adrian, LLP

(57) ABSTRACT

The present invention provides a golf club improved in ball hitting sound and ball hitting feeling and its manufacturing method. First, low-carbon steel is subjected to press processing of hot forging to form portions of irregularity on the face on a side of a hitting surface. Then, when there are projecting portions in the portions of irregularity, only the projecting portions are subjected to press processing of cold forging to crush the projecting portions to be flat. Then, the surface is slightly smoothed by machining to be flat and crystal grains at the portions of irregularity and the area therearound are pressed to be fined, thereby enhancing the hardness and forming fiber flows parallel to the hitting surface. A part of the hardened face becomes harder than the hardness of a base material before press processing by 10% or more within a range of 1 mm in a depth.

3 Claims, 23 Drawing Sheets

FIG.13

| | | 0.2mm | 0.4mm | 0.6mm | 0.8mm | 1.0mm | 1.5mm | 2.0mm | 2.5mm | 3.0mm | 4.0mm | 5.0mm |
|---|---|---|---|---|---|---|---|---|---|---|---|---|
| BEFORE PRESS | A | 146 | 139 | 141 | 135 | 137 | 141 | 139 | 135 | | | |
| | B | 134 | 134 | 137 | 133 | 135 | 140 | 130 | 135 | | | |
| | C | 138 | 135 | 140 | 132 | 136 | 137 | 136 | 135 | | | |
| ROUND PROJECTING (SMALL) PRESS COMPLETED | A | 187 | 181 | 179 | 181 | 178 | 168 | 166 | 168 | 158 | 146 | 139 |
| | B | 209 | 202 | 188 | 194 | 174 | 157 | 140 | 136 | | | |
| | C | 220 | 208 | 197 | 194 | 186 | 170 | 145 | 140 | | | |
| ROUND PROJECTING (SMALL) SCORE LINES COMPLETED | A | 160 | 157 | 162 | 155 | 159 | 164 | 174 | 180 | 176 | 155 | 155 |
| | B | 199 | 184 | 180 | 179 | 170 | 157 | 139 | 138 | | | |
| | C | 225 | 211 | 210 | 202 | 184 | 163 | 149 | 146 | | | |
| VERTICAL (SMALL) PRESS COMPLETED | A | 200 | 206 | 199 | 188 | 181 | 174 | 181 | 181 | 171 | 156 | 148 |
| | B | 220 | 195 | 180 | 178 | 172 | 153 | 144 | 138 | | | |
| | C | 215 | 214 | 223 | 212 | 197 | 175 | 152 | 146 | | | |
| VERTICAL (SMALL) SCORE LINES COMPLETED | A | 167 | 167 | 172 | 170 | 172 | 172 | 164 | 171 | 168 | 163 | 154 |
| | B | 202 | 188 | 181 | 170 | 174 | 155 | 140 | 136 | | | |
| | C | 187 | 193 | 194 | 184 | 170 | 152 | 143 | 140 | | | |

FIG.17

| | FRONT VIEW | CROSS-SECTIONAL VIEW |
|---|---|---|
| 1. LATERAL STRIPE (PROJECTING PORTION HAVING RIDGE SHAPE) | SOLID LINE: RIDGE OF PROJECTING PORTION | CONVEX R 1.0<br>HEIGHT 0.6mm<br>CONCAVE R 1.5 |
| 2. VERTICAL STRIPE (PROJECTING PORTION HAVING RIDGE SHAPE) | SOLID LINE: RIDGE OF PROJECTING PORTION | CONVEX R 1.0<br>HEIGHT 0.6mm<br>CONCAVE R 1.5 |
| 3. LATERAL STRIPE (PROJECTING PORTION HAVING TRAPEZOIDAL SHAPE) | NO HATCHED: PROJECTING PORTION | CONVEX<br>HEIGHT 1.0mm<br>φ2~20<br>CONCAVE |
| 4. VERTICAL STRIPE (PROJECTING PORTION HAVING TRAPEZOIDAL SHAPE) | NO HATCHED: PROJECTING PORTION | CONVEX<br>HEIGHT 1.0mm<br>φ2~20<br>CONCAVE |
| 5. VERTICAL WAVE (PROJECTING PORTION HAVING RIDGE SHAPE) | SOLID LINE: RIDGE OF PROJECTING PORTION | CONVEX R 1.0<br>HEIGHT 0.6mm<br>CONCAVE R 1.5 |
| 6. LATERAL WAVE (PROJECTING PORTION HAVING RIDGE SHAPE) | SOLID LINE: RIDGE OF PROJECTING PORTION | CONVEX R 1.0<br>HEIGHT 0.6mm<br>CONCAVE R 1.5 |
| 7. ROUND SHAPE (PROJECTING PORTION HAVING RIDGE SHAPE) | CENTER OF CIRCRE:<br>TOP OF PROJECTING PORTION | CONVEX R 1.0<br>HEIGHT 0.6mm<br>CONCAVE R 1.5 |

1. LATERAL STRIPE SHAPE (PROJECTING PORTION HAVING RIDGE SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 252 | 243 | 261 | 195 |
| 0.4 | 165 | 269 | 215 | 278 | 173 |
| 0.6 | 165 | 278 | 220 | 259 | 180 |
| 0.8 | 167 | 253 | 204 | 255 | 169 |
| 1.0 | 172 | 235 | 285 | 250 | 170 |
| 1.5 | 179 | 195 | 165 | 224 | 179 |
| 2.0 | 176 | 182 | 176 | 220 | 196 |
| 2.5 | 166 | 181 | 168 | 214 | 207 |

2. VERTICAL STRIPE SHAPE (PROJECTING PORTION HAVING RIDGED SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 234 | 198 | | |
| 0.4 | 165 | 258 | 196 | | |
| 0.6 | 165 | 266 | 178 | | |
| 0.8 | 167 | 253 | 166 | | |
| 1.0 | 172 | 243 | 153 | | |
| 1.5 | 179 | 212 | 155 | | |
| 2.0 | 176 | 209 | 169 | | |
| 2.5 | 166 | 198 | 181 | | |

3. LATERAL STRIPE SHAPE (PROJECTING PORTION HAVING TRAPEZOIDAL SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 253 | 244 | 239 | 178 |
| 0.4 | 165 | 254 | 231 | 238 | 170 |
| 0.6 | 165 | 270 | 253 | 256 | 170 |
| 0.8 | 167 | 250 | 256 | 235 | 171 |
| 1.0 | 172 | 276 | 242 | 250 | 155 |
| 1.5 | 179 | 240 | 204 | 258 | 163 |
| 2.0 | 176 | 217 | 165 | 272 | 178 |
| 2.5 | 166 | 196 | - | 262 | - |

4. VERTICAL STRIPE SHAPE (PROJECTING PORTION HAVING TRAPEZOIDAL SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 258 | 224 | | |
| 0.4 | 165 | 258 | 214 | | |
| 0.6 | 165 | 252 | 229 | | |
| 0.8 | 167 | 261 | 233 | | |
| 1.0 | 172 | 242 | 208 | | |
| 1.5 | 179 | 228 | 186 | | |
| 2.0 | 176 | 234 | 180 | | |
| 2.5 | 166 | 242 | - | | |

5. VERTICAL WAVED SHAPE (PROJECTING PORTION HAVING RIDGE SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 268 | 217 | | |
| 0.4 | 165 | 266 | 215 | | |
| 0.6 | 165 | 261 | 201 | | |
| 0.8 | 167 | 267 | 187 | | |
| 1.0 | 172 | 253 | 199 | | |
| 1.5 | 179 | 245 | 194 | | |
| 2.0 | 176 | 218 | 196 | | |
| 2.5 | 166 | 201 | 193 | | |

6. LATERAL WAVED SHAPE (PROJECTING PORTION HAVING RIDGE SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 249 | 221 | | |
| 0.4 | 165 | 264 | 194 | | |
| 0.6 | 165 | 258 | 195 | | |
| 0.8 | 167 | 263 | 189 | | |
| 1.0 | 172 | 252 | 185 | | |
| 1.5 | 179 | 228 | 174 | | |
| 2.0 | 176 | 220 | 177 | | |
| 2.5 | 166 | 208 | 191 | | |

7. ROUND SHAPE (PROJECTING PORTION HAVING RIDGED SHAPE)

| DEPTH mm | BEFORE PRESS Hv | CENTER PORTION | | END PORTION | |
|---|---|---|---|---|---|
| | | PROJECTING PORTION Hv | RECESSED PORTION Hv | PROJECTING PORTION Hv | RECESSED PORTION Hv |
| 0.2 | 173 | 270 | 224 | 261 | 207 |
| 0.4 | 165 | 269 | 218 | 259 | 209 |
| 0.6 | 165 | 267 | 212 | 266 | 212 |
| 0.8 | 167 | 261 | 201 | 266 | 212 |
| 1.0 | 172 | 259 | 197 | 256 | 214 |
| 1.5 | 179 | 207 | 166 | 233 | 199 |
| 2.0 | 176 | 179 | 163 | 212 | 193 |
| 2.5 | 166 | 174 | 158 | 200 | 199 |

FIG.25

IN CASE OF ROUND PROJECTING PORTION

| HITTING POSITION | NUMBER OF TIMES OF HITTING | DENT AMOUNT [mm] | | PRESENCE OR ABSENCE OF GENERATION OF CORRUGATION |
|---|---|---|---|---|
| | | FACE | TOP PORTION | |
| | BEFORE HITTING | 0.00 | 0.00 | ABSENT |
| Z IN FIG. 27 | 1,000 HITS | 0.00 | -0.01 | ABSENT |
| | 2,000 HITS | -0.01 | -0.01 | ABSENT |
| | 3,000 HITS | -0.01 | -0.01 | ABSENT |
| Y IN FIG. 27 | 200 HITS | -0.03 | -0.01 | ABSENT |

FIG.26

IN CASE OF VERTICAL PROJECTING PORTION

| HITTING POSITION | NUMBER OF TIMES OF HITTING | DENT AMOUNT [mm] | | PRESENCE OR ABSENCE OF GENERATION OF CORRUGATION |
|---|---|---|---|---|
| | | FACE | TOP PORTION | |
| | BEFORE HITTING | 0.00 | 0.00 | ABSENT |
| Z IN FIG. 27 | 1,000 HITS | 0.00 | 0.00 | ABSENT |
| | 2,000 HITS | 0.00 | 0.00 | ABSENT |
| | 3,000 HITS | 0.00 | 0.00 | ABSENT |
| Y IN FIG. 27 | 200 HITS | -0.02 | -0.01 | ABSENT |

GOLF CLUB HEAD AND METHOD FOR MANUFACTURING THE SAME

FIELD OF THE INVENTION

The present invention relates to a golf club head and a method for manufacturing the same, and more particularly to a golf club head in which strength and hardness of a face surface is increased by pressing crystal grains at the face surface to fine the crystal grains thereby obtaining high hardness and forming fined fiber flows, and a method for manufacturing the same.

BACKGROUND OF THE INVENTION

Ball hitting sound and ball hitting feeling are major factors of the properties of golf clubs. For an iron club head, a head manufactured by hot forging of low-carbon steel, that is, manufactured by forging so called soft iron is regarded to provide good ball hitting sound and ball hitting feeling. The main two types of the shape of the iron club head are a muscle back type in which mass is not distributed to the periphery and a cavity back type in which mass is distributed to the periphery and a cavity is formed on the rear surface side of the face to increase the sweat area.

It is generally regarded that a muscle back type is superior than a cavity back type as for hitting sound and hitting feeling. This is because it is said that robust structure (thickness), manufacturing method (fining), softness of material are mixed to generate an effect that a soft feeling can be obtained while providing a stable response. Mass is distributed to the periphery of the head in a cavity back type, so that the thickness of the face is relatively thinner than that of a muscle back type.

Accordingly, it is said that a cavity back type does not provide good ball hitting feeling relatively. Since it is also said that the sweet area of a muscle back type is smaller than that of a cavity back type, a muscle back type is considered to be favorable for the experienced. This is due to necessity for a shot of a sliced ball or a hooked ball and handling ability. However, it is required to further improve ball hitting sound and ball hitting feeling also in a cavity back type. In order to improve ball hitting properties, superior advantages of a muscle back type should be applied also to a cavity back type.

To this end, it is effective to increase the hardness of the face without quenching to provide a golf club which can give good shot feeling. The present applicant proposed a golf club in which a plurality of recesses are formed by forging on the rear surface of the face to improve the strength of the face in order to reduce the thickness of the face and to increase the sweet area in a golf club head (see Japanese Patent Application Laid-open No. H9-38252: Patent Document 1). The invention described in Patent Document 1 achieved to reduce the thickness of the face but failed to improve ball hitting feeling. A golf club was also proposed in which the hitting surface of the face is modified to have hardness distribution of a striped pattern along score lines in order to apply large rolling capability to a ball for long distance (e.g., see Japanese Patent Application Laid-open No. H10-108927: Patent Document 2).

In the invention described in Patent Document 2, two or more materials having different hardness are overlapped and joined by diffusion or subjected to heat treatment by irradiation of laser beam for heat treatment in a striped manner to give hardness distribution of a striped pattern to the hitting face. Since heat treatment is performed with laser beam in order to increase the hardness, composition near the surface of the hitting face is hardened but forging effects may be reduced by the heat of the laser beam. Moreover, a technique for distributing fiber flows in a face portion is known (e.g., see Japanese Patent Application Laid-open No. 2009-261908: Patent Document 3). Further, a golf club head is known in which the face surface is subjected to carburizing treatment to increase surface hardness and hardness of the face surface is differentiated in a stepwise manner in the thickness direction (e.g., see Japanese Patent Application Laid-open No. 2005-319019: Patent Document 4). Furthermore, a case is known in which the face portion is subjected to blast processing after engraving score lines (e.g., see Japanese Patent Application Laid-open No. 2004-141277: Patent Document 5).

In recent years, attention has been paid to ball hitting sound and ball hitting feeling with the change of the rule about spring-like effect (SLE). That is, comfortability of ball hitting sound and ball hitting feeling has been emphasized as well as rebound characteristics, directional property, carry, etc. In order to quantitatively evaluate the ball hitting sound and ball hitting feeling, a research for measuring bending strain of a shaft and vibration transmitted to hand has been conducted. However, there is no decisive definition as for ball hitting sound and ball hitting feeling that brings confotability. It has been attempted to give quantitative evaluation in various ways in addition to giving qualitative evaluation by players. As an example, it has been known that vibration of a shaft in circumferential direction is measured with a three-axis acceleration meter and the data is analyzed to evaluate ball hitting feeling (e.g., see Japanese Patent Application Laid-open No. 2008-125722: Patent Document 6). Also, in Patent Document 3, results of evaluation by ball hitting sound whose frequency is relative low and which leaves lingering sound are also disclosed. In any case, to increase the hardness of the face without quenching is effective for ball hitting sound and ball hitting feeling, so that a proposal concerning the relationship has been desired.

SUMMARY OF THE INVENTION

The present invention has been conceived in light of the above-mentioned technical back ground and attains the objects to be described below.

An object of the present invention is to provide a golf club head improved in ball hitting sound and ball hitting feeling even when the thickness of the face portion is thin by subjecting the face to forging for forming portions of irregularity in a golf club head manufactured by forging metal such as low carbon steel and having a face and a neck, in particular, in a golf club head of a cavity back type in which a cavity is formed on the side opposite to the hitting surface of the face and a method for manufacturing the same. Another object of the invention is to provide a golf club head that is highly hardened in the hitting face by pressing crystal grains near the surface of the hitting face for fining, high hardening and formation of fiber flows parallel with the hitting face, and a method for manufacturing the same.

The invention is equipped with the following means to achieve the above mentioned objects.

According to a first aspect of the invention, a golf club head is provided in which a cavity (2*c*) is formed on the rear side of the face (2), wherein a hitting surface (2*a*) to hit a ball and/or the surface opposite to the hitting surface (2*a*) of the face (2) are/is partially forged, and a plurality of hardened portions, which are harder by at least 10% than the Vickers hardness (Hv) of the base material constituting the hitting surface (2*a*) within the range of 1.0 mm in depth from the forged surface, and a plurality of portions, which are less hard relative to the hardened portions and harder than the hardness (Hv) of the base material, are distributed in the face (2).

According to a second aspect of the invention, a golf club head is provided, in the first aspect of the invention, wherein a plurality of portions of irregularity are formed partially on the hitting surface (2*a*) and/or the surface opposite to the hitting surface (2*a*), and said plurality of portions of irregularity have configuration, as viewed from the front side of the hitting surface, selected from plurality of circular shapes, plurality of spherical shapes, linear band shapes and waved band shapes and each projecting portion of the portions of irregularity has a cross-sectional shape of a mountain-like triangle or a trapezoid.

According to a third aspect of the invention, a method for manufacturing a golf club head, which is manufactured by hot forging of low-carbon steel and in which a cavity (2*c*) is formed on the rear side of the face (2), is provided; the method comprising the steps of: forming a plurality of portions of irregularity (5) by press processing during the hot forging in order to form the hitting surface (2*a*) for hitting a ball on the face (2); and flattening the forged surface of the portions of irregularity after forming the portions of irregularity so as to fine crystal grains in the portions of irregularity and the areas therearound and to form fiber flows thereby increasing strength and hardness of the hitting surface.

According to a fourth aspect of the invention, a method for manufacturing a golf club head is provided, in the third aspect, wherein the portions of irregularity have configuration, as viewed from the front side of the hitting surface, selected from plurality of circular shapes, linear band shapes and waved band shapes and each projecting portion of the portions of irregularity has a cross-sectional shape of a mountain-like triangle or a trapezoid.

According to a fifth aspect of the invention, a method for manufacturing a golf club head is provided, according to the third or fourth aspect, wherein an iron golf club is manufactured by the method in which only projecting portions are crushed to be flat by cold forging after forming the portions of irregularity and thereafter the hitting face is subjected to machining process to smooth the surface by cutting processing, and score lines are formed on the hitting surface by processing by coining after the machining process.

In the golf club head according to the invention, the hardness of the ball hitting face can be increased without quenching by forming portions of irregularity on the hitting surface of the face and performing forging for crushing and fining crystal grains. Furthermore, the strength of the face can be increased by forming fiber flows in the face during the process of forging. As a result the golf club head has toughness, can give pleasant shot feeling and becomes suitable in ball hitting sound and ball hitting feeling.

Since it is not necessary to perform quenching in the method for manufacturing the golf club head according to the invention, manufacturing of the golf club head is easy. Moreover, by performing machining process and score line forming process after the process of forging, manufacturing of the golf club head becomes easy. Furthermore, hardness of the hitting face is increased and fiber flows are formed in the process of forging, so that the strength of the hitting face can be increased.

BRIEF DESCRIPTION OF THE DRAWINGS

FIG. 13 is a chart of hardness data when the shape of the projecting portion is differentiated, illustrating a numerical table;

FIG. 17 is an explanatory diagram illustrating various types of portions of irregularity;

FIG. 25 illustrates data of an endurance test and is a chart of data when the projecting portion has a round projection shape;

FIG. 26 illustrates data of an endurance test and is a chart of data when the projecting portion has a columnar projecting shape;

DESCRIPTION OF THE PREFERRED EMBODIMENTS

Figure 1:
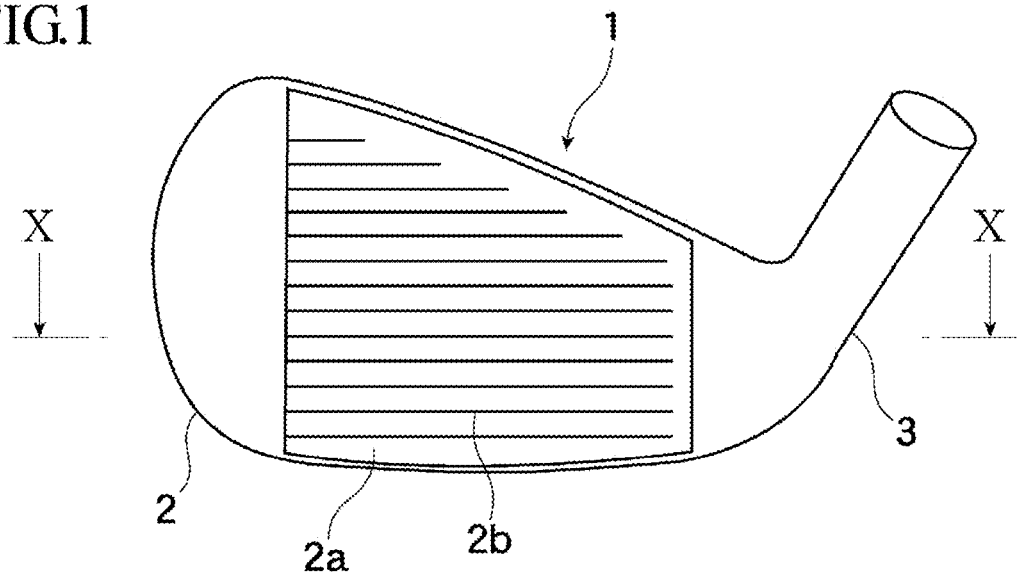
FIG. 1 is a front view of a golf club head.

An embodiment of the invention will be described in detail with reference to the accompanying drawings. The main parts of a golf club head body is a metallic iron head as illustrated in FIG. 1 and an iron head body 1 (hereinafter, referred to as a "head 1") includes a face 2 and a neck 3 to be coupled with a shaft. The face surface 2*a* which is a surface for hitting a ball is formed on the face 2, and score lines 2*b* are formed on the face surface 2*a*. As described above, there are a muscle back type, in which mass is not distributed to the periphery thereof, and a cavity back type, in which mass of the center portion is distributed therearound, in the head 1.

It is conventionally said that the muscle back type is favorable for experienced because ball hitting sound, ball hitting feeling and handling ability are good. On the other hand, the cavity bag type is a type in which the thickness is smaller and the sweet area is larger than those of the muscle back type, so that the cavity bag type pursues easier play and has been widespread. Besides, there is a hollow type in which a hollow is provided in the iron head. FIG. 1 is a front view of the golf club head of a cavity back type and, as described above, the head 1 is equipped with a face 2 and a neck 3 for connecting a shaft.

Figure 2:
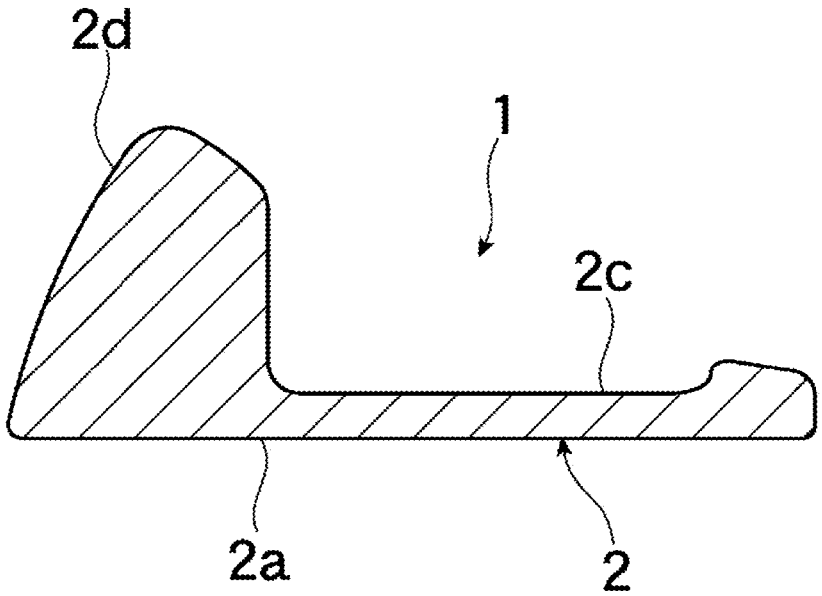
FIG. 2 is a cross-sectional view taken along the line X-X of FIG. 1.

FIG. 2 is a cross sectional view taken along the line X-X of the head 1. A cavity 2*c* is formed at the center of the rear surface of the face 2 and amass portion 2*d* is distributed around the cavity 2*c*. The head 1 is soft low-carbon steel. The face 2 and the neck 3 are integrated and formed by forging. Accordingly, plurality of fiber flows are continuously formed from the face 2 to the neck 3 in the head 1. By formation of the fiber flows, the head 1 has high strength and toughness and uniform composition. Next, a method for manufacturing the golf club head will be described.

Figure 3:
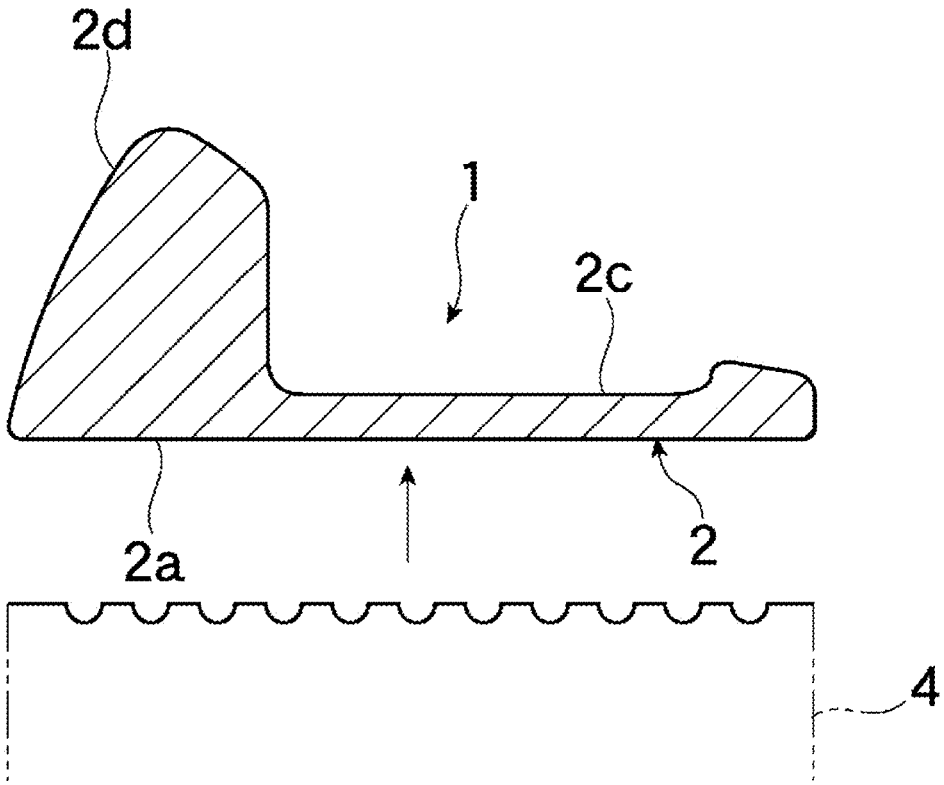
FIG. 3 is an explanatory diagram illustrating, in a cross sectional view, a method for forming portions of irregularity on the face by press processing.
Figure 4:
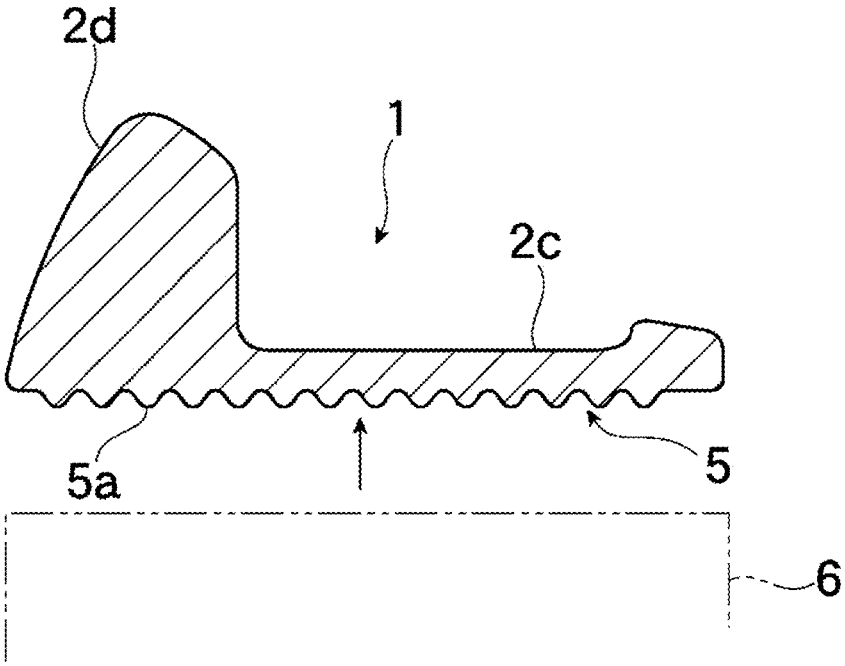
FIG. 4 is an explanatory diagram illustrating, in a cross sectional view, a method for crushing only projecting portions of the portions of irregularity by press processing.

Although description with reference to a drawing is omitted, the head of the embodiment is formed by subjecting a round bar of soft low-carbon steel to deformation working through hot forging. The round bar is forged with a punch or a roll while rotating or reversing the round bar to perform stretch processing for manufacturing. So called fiber flows are generated in the forging process. Alternatively, fiber flows (metal flows) are formed in the step of manufacturing the round bar. In the forging, a dies (not shown) is generally used to perform rough forge molding by plurality of times with a punch, etc. As shown in FIGS. 3 and 4, portions of irregularity 5 are formed on the face surface 2*a* with a punch 4 in a finishing forging process of a hot forging process.

Figure 5:
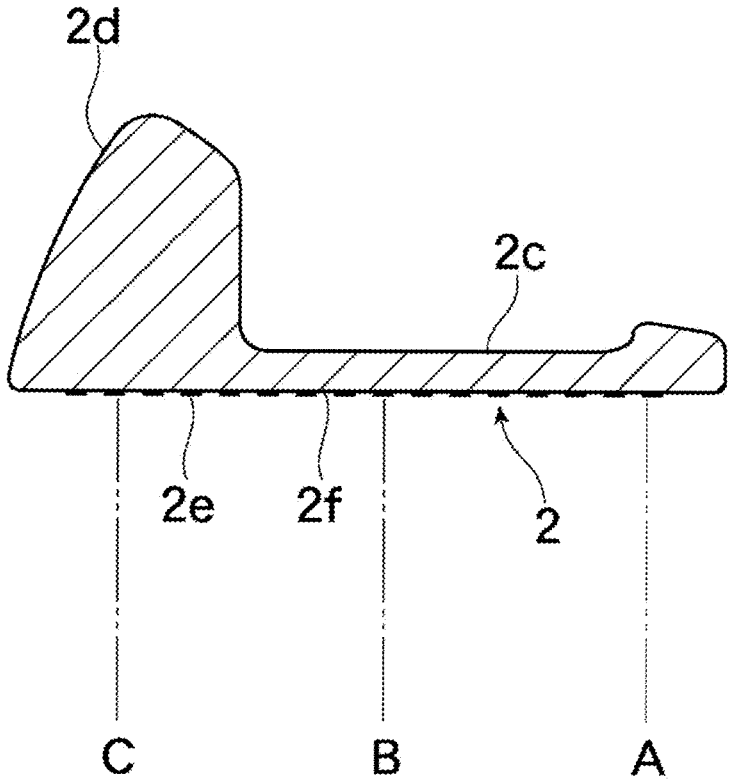
FIG. 5 is an explanatory diagram illustrating, in a cross sectional view, a state of the face after the projecting portions are crushed by press processing.

That is, the portions of irregularity 5 are formed by press processing of hot forging with the dies shape of a punch 4 secured to the ram of the pressing machine. Next, precision forging, namely precision cold forging is performed through cold forging. In the embodiment, a 500 ton-hydraulic press was used as the press machine used in the precision cold forging. The pressing face of the punch 6 of the hydraulic press is flat as shown in FIG. 4. The portions of irregularity 5 of the face surface 2*a* are subjected to press processing with the punch 6, as shown in FIG. 4. The press processing is a kind of coining and only projecting portions 5*a* of the portions of irregularity 5 are crushed towards the face surface 2*a*. When press processing is performed by cold forging, the face 2 having partially high hardness portions is formed, as shown in FIG. 5.

Figure 6:
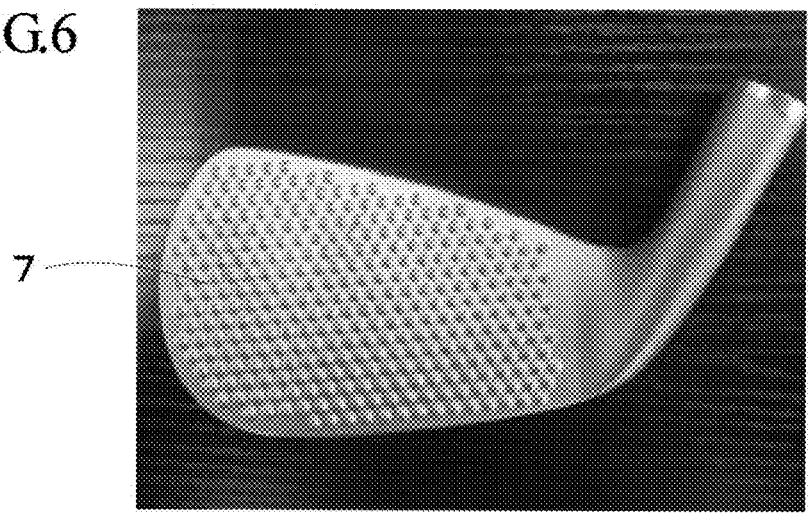
FIG. 6 is a photograph illustrating the front side of the golf club head after press processing and before cold working in a case where the projecting portion of the face has a round shape.
Figure 7:
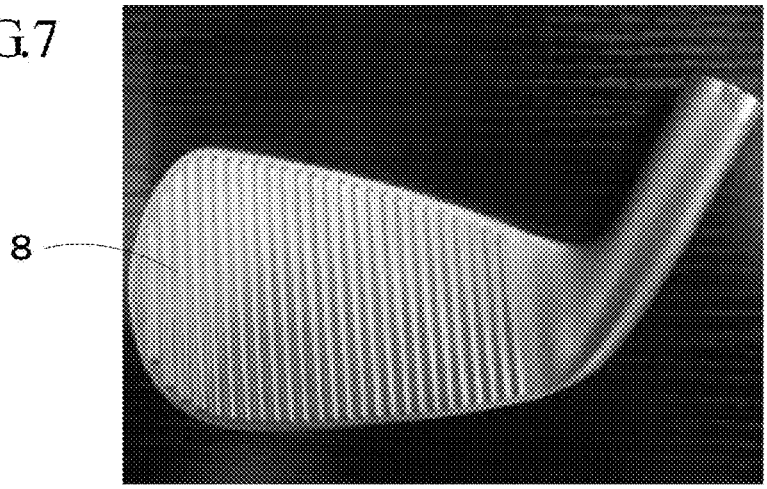
FIG. 7 is a photograph illustrating a front side of the golf club head after press processing and before cold working in a case where the projecting portion of the face has a columnar shape.

That is, the portions of irregularity 5 formed by press processing with the punch 4 shown in FIG. 3 has plurality of arrayed circular shapes in front view of the face 2 as a hitting surface. However, the shape is not limited to the plurality of circular shapes but plurality of portions of a straight band shape, a snaked band shape, etc. may be arranged at regular intervals. In the embodiment, the arrayed projecting portions, each having a circular shape and being projecting at the center, are formed on the entire surface and the configuration of the projecting portions is shown in the photograph in FIG. 6. The projecting portion has a shape of "7. round shape" as shown in FIG. 17 in a cross-sectional shape that is a hemisphere shape in a cross-sectional view and a circular shape with diameter of about 3 mm in front view. This projecting portion is formed by forming plurality of circular projecting portions on the face surface 2*a*. As shown in FIG. 7, portions of irregularity 8, each having a band shape, may be formed on the face surface 2*a* in a vertical direction. Alternatively, the cross-sectional shape of the projecting portion may be a triangular ridged shape, a hemicycle shape, a trapezoidal shape, etc.

Press processing by the punch 6 is deformation processing for crushing only the projecting portions among the portions of irregularity 5 and is precision cold forging for smoothing the surface in order to generate difference in hardness. In the press processing method, only the projecting portions 5*a* of the face 2 is pressed to be crushed. That is, in the press processing, the thick portions which are the projecting portions 5*a* are pressed to be sunk into the head 1, which fines the metal crystal grains. Herewith, the hardness of the projecting portions 5*a*, that is, the hardness of the scattered circular shapes and therearound are increased. Although the face surface 2*a* becomes flat by the press processing, some roughness (gentle waved irregularity) still remains due to spring back effect or the like.

The case when forming the projecting portions each having a circular shape has been described above. Likewise, the press processing may also be applied to the case when plurality of recessed portions are formed on the face surface in linear configuration. The description has been made above on the premise that press processing for forming the portions of irregularity is performed on the front surface of the face. Similar press processing may be performed also on the surface opposite to the front surface in order to obtain similar effects. That is, similar difference in hardness can be provided on the front surface of the face even when press processing is performed on the rear surface of the face. In this case, although there are restrictions of the thickness and shape in the face portion, forging can be easily performed, so that the face having difference in hardness along fiber flows can be obtained similar to the front surface of the face. Since the forging method of the rear surface is similar to that of the front surface, the detailed description is omitted here.

After the cold press processing, in order to remove the above-mentioned roughness of difference in level (irregularity), machining of milling is performed on the face surface 2*a* for flattening (machining process). The machining process is not limited to milling but other processing methods may be available. Although the flattening may be made by grinding processing, the grinding processing may destroy fined composition to lower the hardness because the processing temperature becomes locally high. Accordingly, it is preferable to avoid grinding processing. Herewith, the face surface 2*a* after machining process becomes a surface in which high hardness portions 2*e* with crystal grains fined and low hardness portions 2*f* with hardness lower than the projecting portion 5*a* side coexist in a mixed manner. Hardness of the low hardness portion 2*f* is increased by some degree by the influence of the press processing to the projecting portion 5*a* side and is not the hardness of the original material.

While projecting portions are formed on the above-mentioned face surface 2*a*, press processing may be performed so as to form recessed portions which are inverse in irregularity, thereby allowing partial increase in the hardness of the face surface in a same manner. The face surface 2*a* partially having high hardness has hardness partially higher as compared with the conventional face surface having high hardness in which quenching is performed on the entire surface, but becomes a soft and tactile face surface as a whole. After the machining process for flattening, score lines 2*b* are formed on the face surface 2*a* by coining processing (sore line forming process). Furthermore, the fiber flows on the face surface 2*a* is further advanced due to the coining processing for forming the score lines, which provides the head 1 having high density and strength.

Therefore, the face surface 2*a* provides soft feeling regardless of the hardness when hitting a ball. Furthermore, the head 1 gives a good influence on ball hitting sound and ball hitting feeling in combination with plurality of high fiber flows having high density from the face 2 to the neck 3. Herewith, even for the head of a cavity back type having thin thickness at the center portion, the head can keep strength and provide good ball hitting sound and ball hitting feeling. While the embodiment of the invention has been described above, the invention is not limited thereto but it goes without saying that modifications may be made within the range without departing from the spirit and gist of the invention.

While the description has been made on the assumption that the present invention is applied in particular to a cavity back type, the present invention may be applied to an iron golf club of a muscle back type. Moreover, the shape of the portion of irregularity is not limited but it goes without saying that the invention may also be applied to shapes other than ones mentioned above to be illustrated in the following working examples. Furthermore, the invention may also be applied to a compound type in which a face portion having a plate like shape and a head body portion are separately formed and joined. Furthermore, as for the material, not only so called soft iron such as S20C and S25C (Japanese Industrial Standards) which are SC steel, but also S45C and S50C (Japanese Industrial Standards) whose carbon content is great among the same SC steel, special steel, stainless steel, titanium, titanium alloy, etc. are applicable.

Working Example 1

Figure 8:
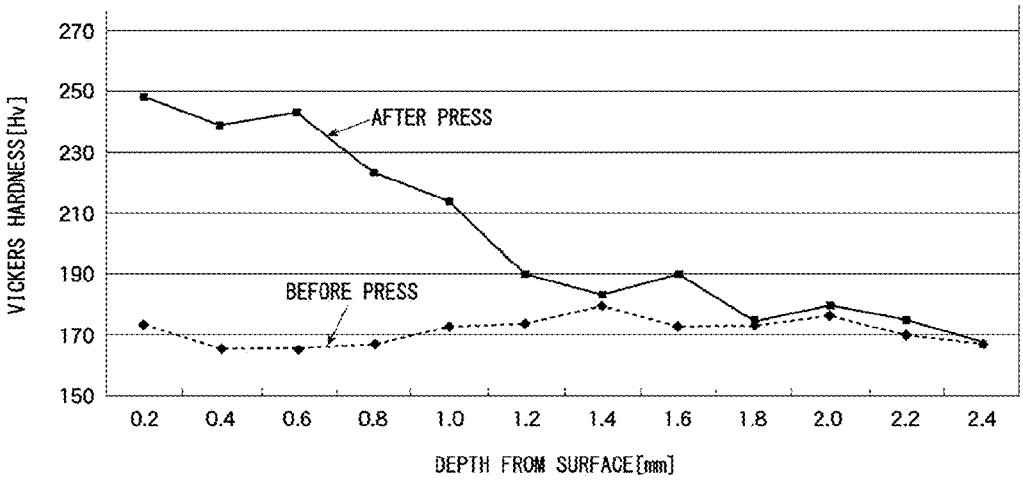
FIG. 8 is a chart of hardness data of a plate material (test piece) corresponding to the face, illustrating a comparison between before and after press processing.

FIG. 8 illustrates data when the processing method according to the invention is applied to a plate material which is a test piece formed of S25C whose material is a general material. The data is hardness data of a portion corresponding to the center portion of the face, and change of hardness of a test piece experimentally manufactured in manufacturing method according to the embodiment was verified. The hardness data shows measurement values of Vickers hardness (Hv) measured with a Vickers hardness tester. The hardness data to be described below is also data of Vickers hardness (Hv) and indicates a comparison in hardness between before and after press processing. Hardness before press processing is 170 Hv in Vickers hardness (corresponding to 87 HRB in Rockwell hardness) and hardness after press processing is 210 to 250 Hv in Vickers hardness (corresponding to 95 to 101 HRB in Rockwell hardness).

Figure 9A:
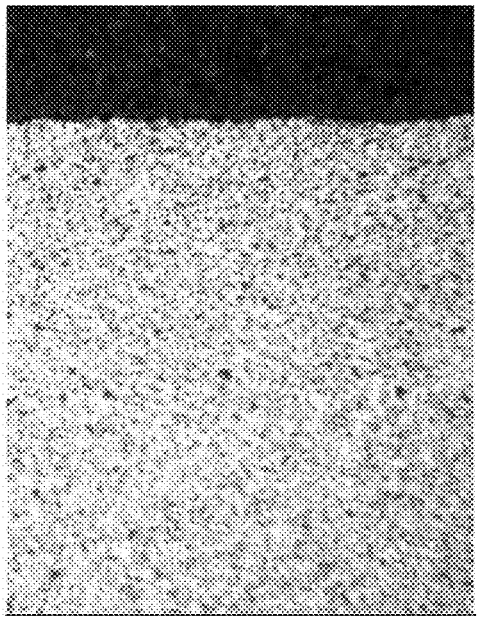
FIGS. 9A and 9B are microscopic photographs of the test piece in its section obtained by a hardness test based on FIG. 8, illustrating its section before and after press processing respectively.
Figure 9B:
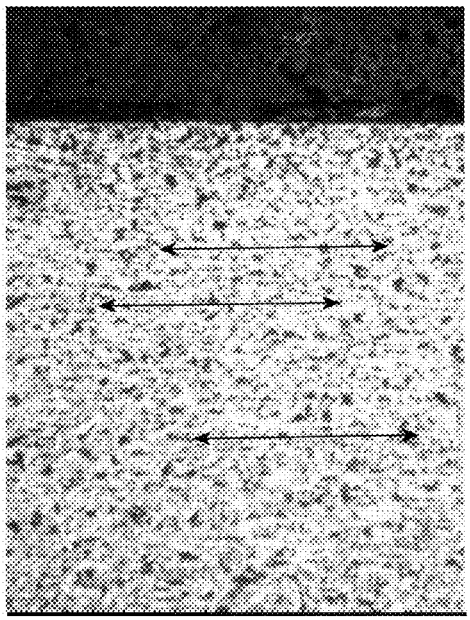

According to the data, the hardness after press processing is increased by 10% to 16% in hardness proportion in Vickers hardness (Hv) as compared with the hardness before press processing within the range of 1 mm in depth. FIGS. 9A and 9B illustrate cross-sectional photographs of the test piece whose data is shown in FIG. 8 and illustrate examples before and after press processing, respectively. Fiber flows can be observed in directions shown by the arrows in FIG. 9B.

Working Example 2

Figure 10:
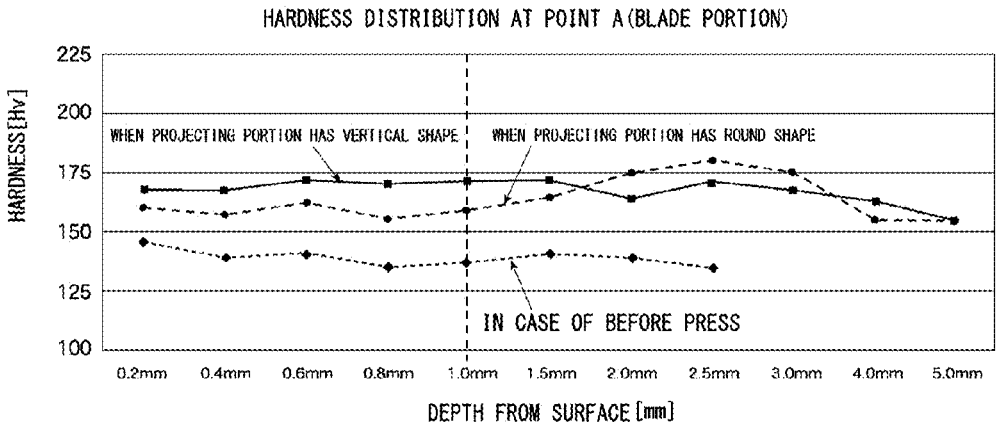
FIG. 10 is a chart of hardness data of a prototype having a head shape according to the invention, illustrating data at a position A of the face shown in FIG. 5.
Figure 11:
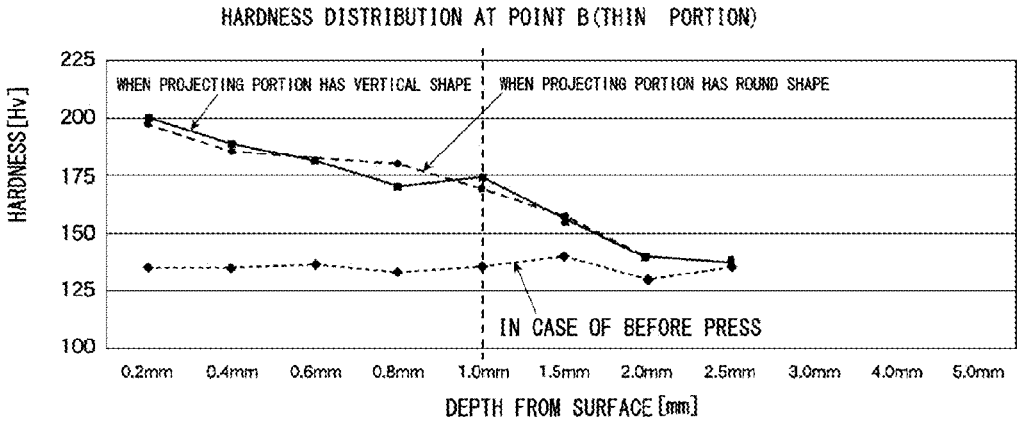
FIG. 11 is a chart of hardness data of a prototype having a head shape according to the invention, illustrating data at a position B of the face shown in FIG. 5.
Figure 12:
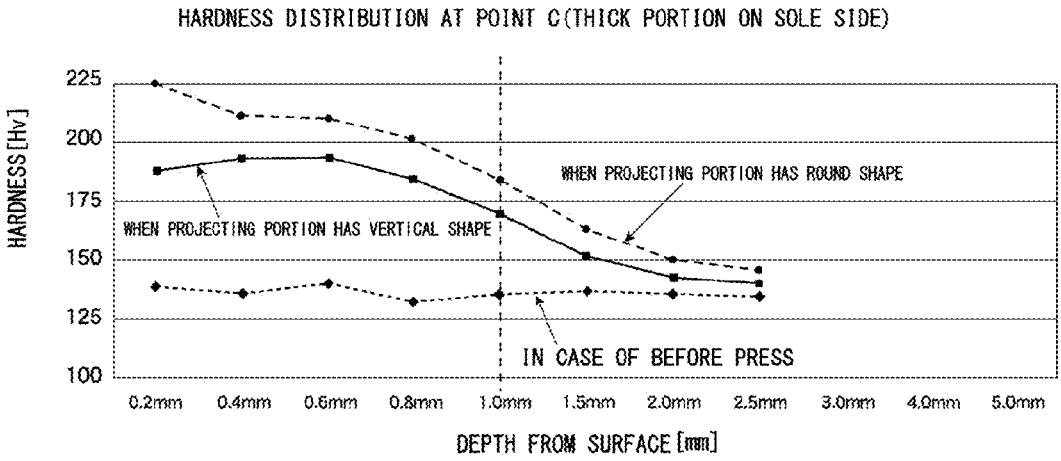
FIG. 12 is a chart of hardness data of a prototype having a head shape according to the invention, illustrating data at a position C of the face shown in FIG. 5.

Data illustrated in FIGS. 10 to 12 is hardness data of a head actually processed by the method according to the embodiment. The hardness data is data when the shape of the projecting portion is a round shape (see photograph shown in FIG. 6) and when a vertical shape (see photograph shown in FIG. 7). Measurement values shown in FIGS. 10 to 12 are measured at the measuring positions of A, B, and C of the head having the shape as shown in FIG. 5, respectively. Each data is indicated for every measuring position.

Working Example 3

FIGS. 13 to 16 illustrate hardness data obtained by measuring a head processed by the method according to the embodiment. The hardness data is numerical data equivalent to that in the Working Example 2 and is the hardness data when the shape of the projecting portion is a round shape (see photograph shown in FIG. 6) and when the shape of the projecting portion is a vertical shape (see photograph shown in FIG. 7). In the Working Example 3, hardness data after coining for forming score lines which is performed after machining is also shown. The measurement values are measured at the measuring positions of A, B, and C, respectively, as shown in FIG. 5, and data is shown for each measuring position.

Figure 14:
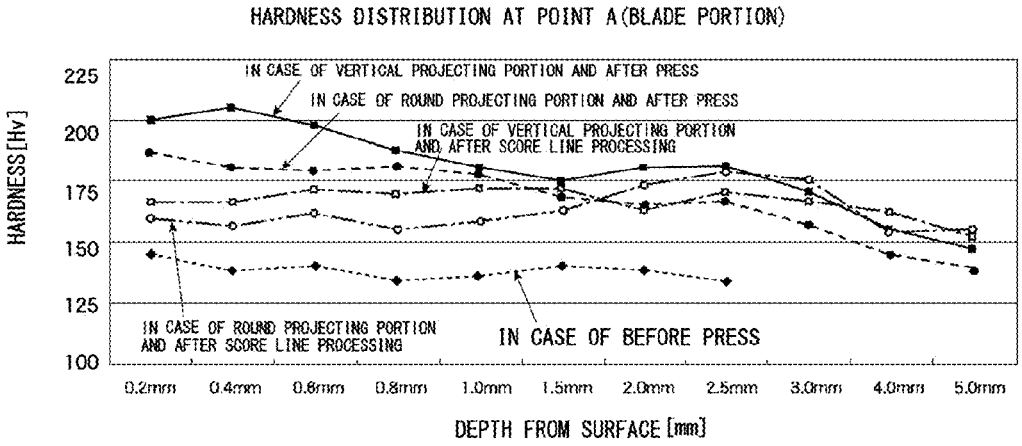
FIG. 14 is a chart of data based on the table shown in FIG. 13, illustrating data at the position A of the face shown in FIG. 5.
Figure 15:
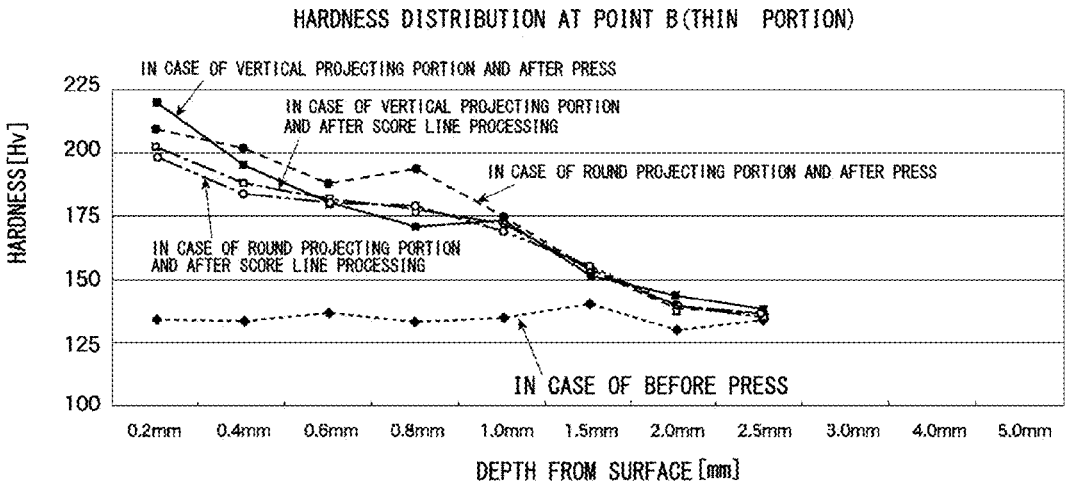
FIG. 15 is a chart of data based on the table shown in FIG. 13, illustrating data at the position B of the face shown in FIG. 5.
Figure 16:
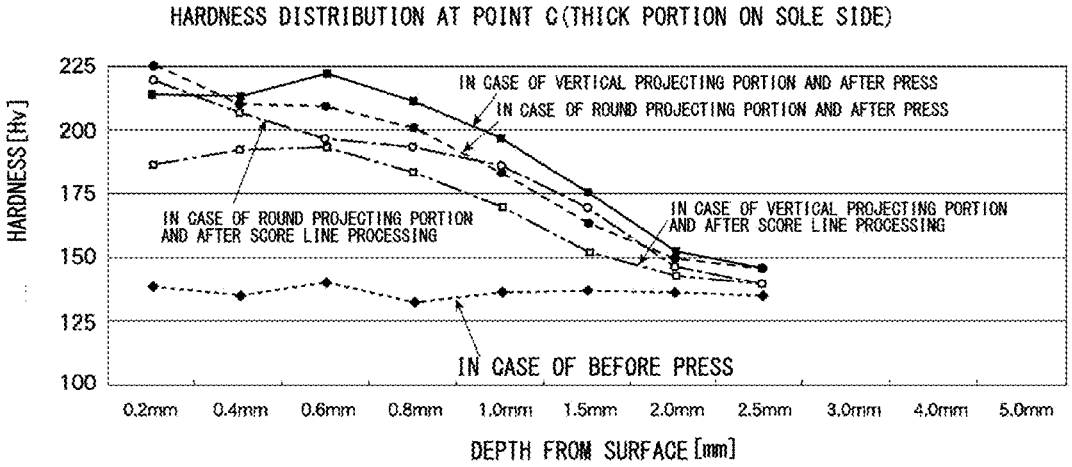
FIG. 16 is a chart of data based on the table shown in FIG. 13, illustrates data at the position C of the face shown in FIG. 5.
Figure 18:
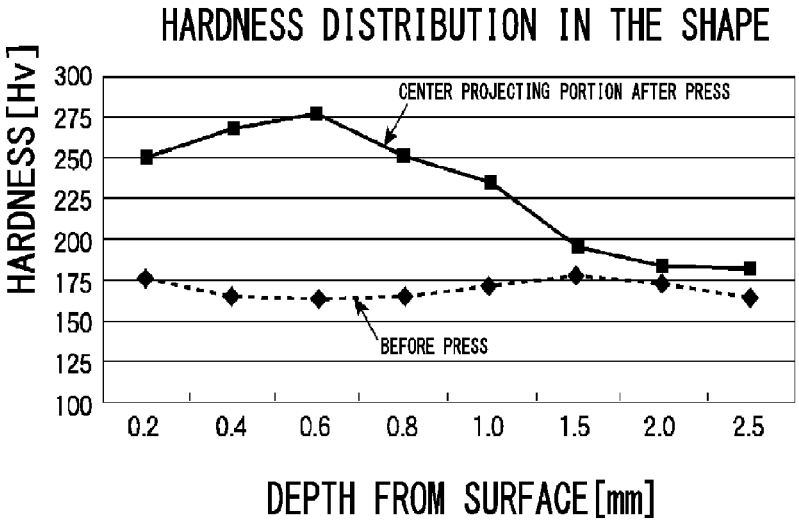
FIG. 18 is a pair of charts of data in the case of a lateral stripe shape (the projecting portion has a ridged shape) in the configuration shown in FIG. 17.
Figure 19:
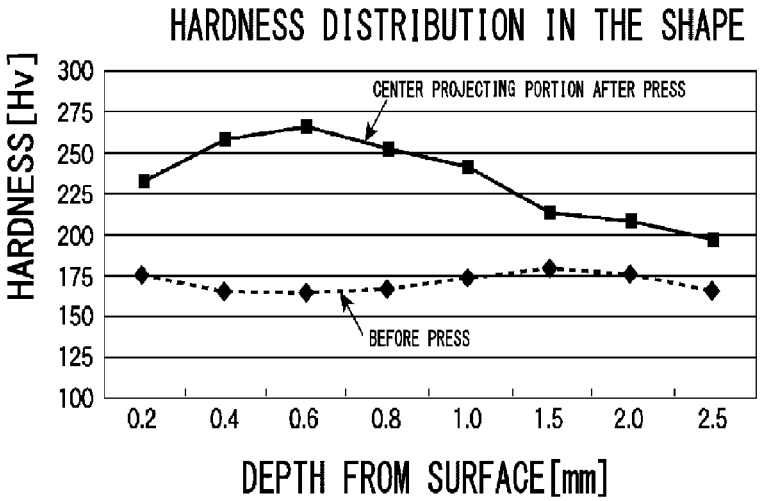
FIG. 19 is a pair of charts of data in the case of a vertical stripe shape (the projecting portion has a ridged shape) in the configuration shown in FIG. 17.
Figure 20:
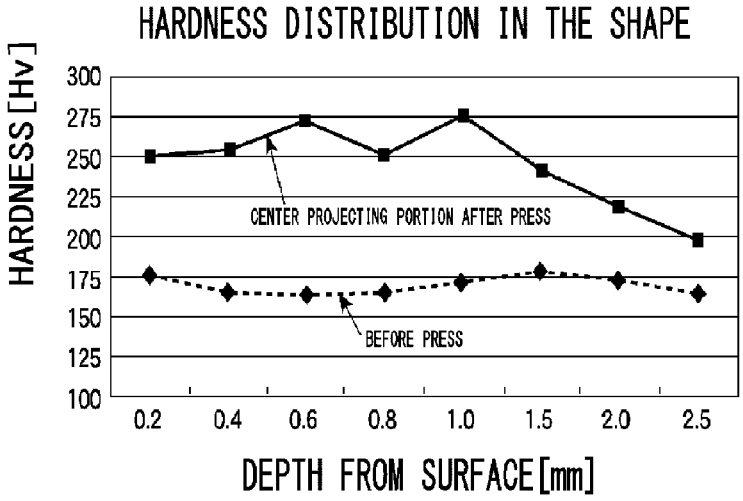
FIG. 20 is a pair of charts of data in the case of a lateral stripe shape (the projecting portion has a trapezoidal shape) in the configuration shown in FIG. 17.
Figure 21:
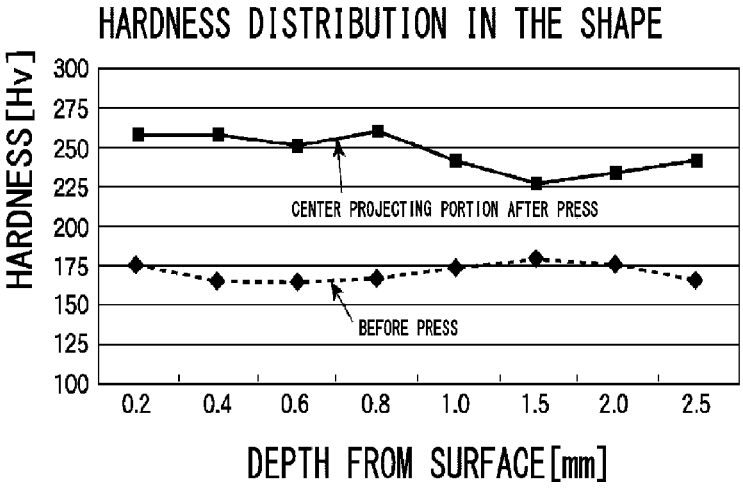
FIG. 21 is a pair of charts of data in the case of a vertical stripe shape (the projecting portion has a trapezoidal shape) in the configuration shown in FIG. 17.
Figure 22:
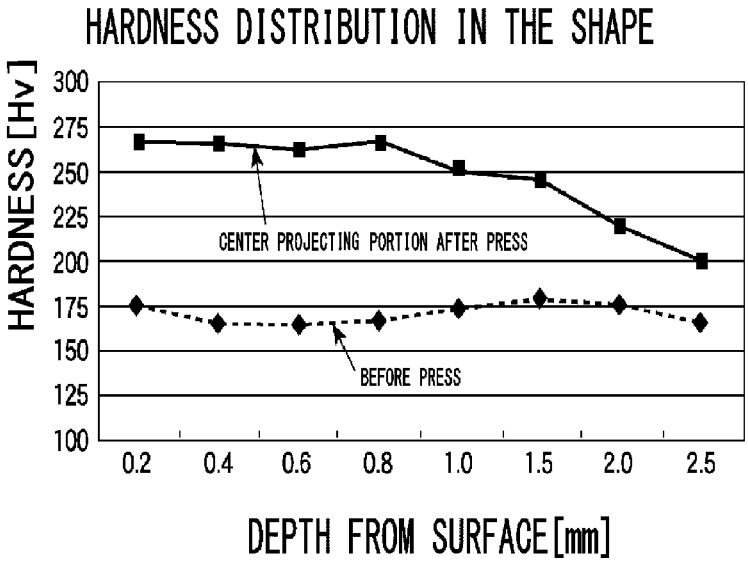
FIG. 22 is a pair of charts of data in the case of a vertical waved shape (the projecting portion has a ridged shape) in the configuration shown in FIG. 17.
Figure 23:
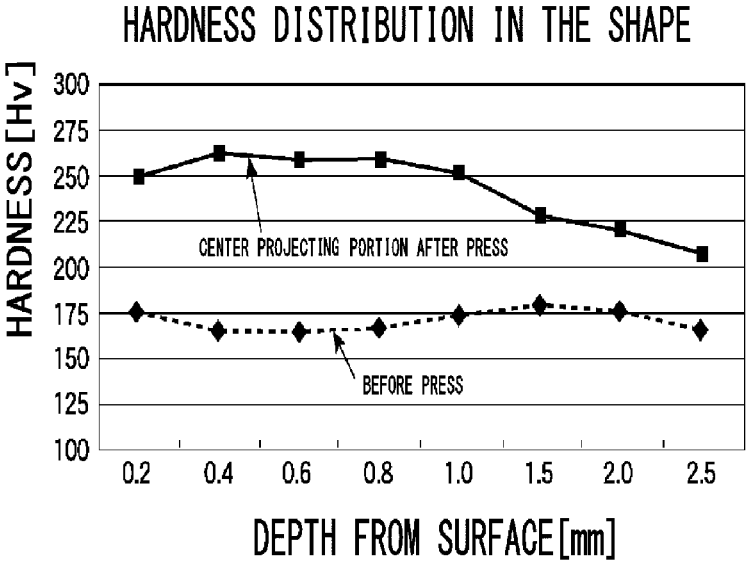
FIG. 23 is a pair of charts of data in the case of a lateral waved shape (the projecting portion has a ridged shape) in the configuration shown in FIG. 17.
Figure 24:
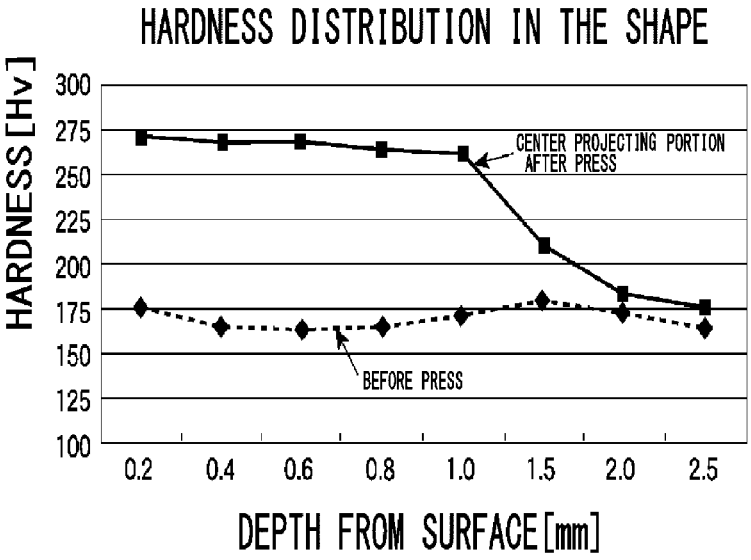
FIG. 24 is a pair of charts of data in the case of a round shape (the projecting portion has a ridged shape) in the configuration shown in FIG. 17.

FIG. 13 is a chart of numerical value data illustrating measurement values and FIGS. 14 to 16 are charts of graph data based on the data shown in FIG. 13 respectively. In every measuring position, the hardness after press processing is higher than that before press processing, and hardness was not decreased also in the data after forming score lines as compared with that before press processing. When coining is performed for forming score lines, the hardness of the portion generally increases. However, in the example, cutting by 0.4 mm was performed by machining, so the hardest portion was cut. Due to this, the hardness was lowered.

Working Example 4

The data in FIGS. 17 to 24 is data of test piece hardness (not of head shapes) in cases where measurement was performed for various shapes of portions of irregularity. The data was obtained for test pieces of S25C after the test pieces were formed to be of flat shape through hot forging, irregularity surface configuration was formed through hot forging and then the surfaces of the test pieces were flattened through press processing by precision cold forging. Accordingly, no test piece was subjected to flattening by machining. The dimension of the test pieces having various surface configurations is 80 mm×50 mm and the thickness is 3.5 mm. FIG. 17 is a chart illustrating the shapes of the portions of irregularity formed by hot forging in front views and cross-sectional views, respectively. Data was obtained for seven exemplified shapes including 1: a lateral stripe shape (the projecting portion has a ridged shape), 2: a vertical stripe shape (the projecting portion has a ridged shape), 3: a lateral stripe shape (the projecting portion has a trapezoidal shape), 4: a vertical stripe shape (the projecting portion has a trapezoidal shape), 5: a vertical waved shape (the projecting portion has a ridged shape), 6: a lateral waved shape (the projecting portion has a ridged shape) and 7: a round shape (the projecting portion has a top shape).

Each numerical data illustrated in FIGS. 18 to 24 represents hardness at various depths from the surface compared between before and after press processing for each of the cross-sectional shapes 1 to 7 shown in FIG. 17. The measurement after press processing was performed at the center and at the end of the test piece and the data is of a recessed portion and of a projecting portion. The graph data illustrate data of the projecting portion after press processing and data before press processing. Every data within the range of 1 mm in depth verifies that the hardness of the projecting portion is higher in a stable manner as compared with that before press processing. Note that the cross-sectional shape shown in FIG. 17 is preferable to be formed not on the front surface but on the rear surface of the face surface since the surface is not smoothed by processing by machining.

Working Example 5

Figure 27:
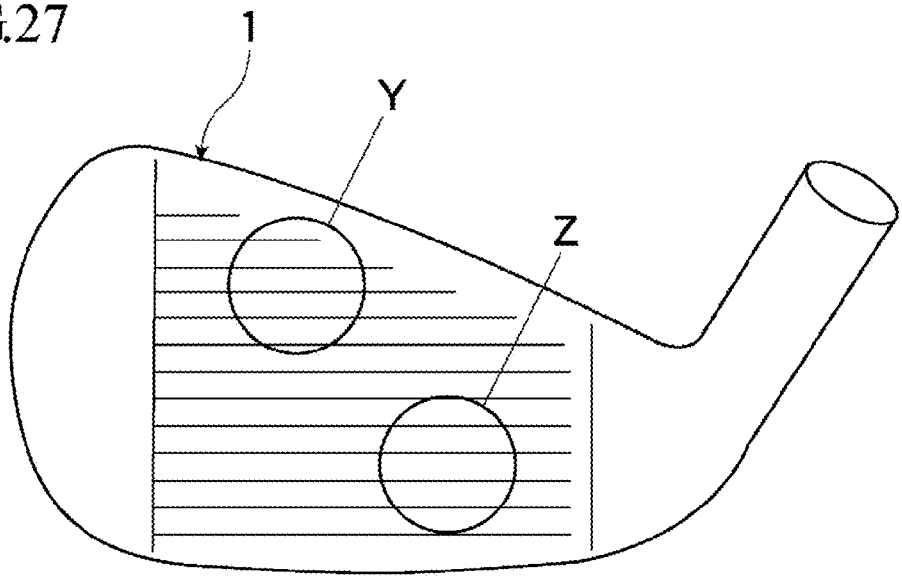
FIG. 27 is a front view of the golf club head illustrating hitting positions for data of the endurance tests.

The numerical data shown in FIGS. 25 and 26 illustrates an endurance test. The data shown in FIG. 25 is data in the case where the projecting portion has a circular projecting shape and FIG. 26 is data in the case where the projecting portion has a vertical projecting shape. Both of the data are data at positions Y and Z which are hitting positions in FIG. 27, that is, the data obtained when golf ball was hit by 1000 to 3000 times actually. The data of 1000 to 3000 times is data at the position Z on the center-heel side. The data of 200 times is data at the position Y on the center-top side. The data was measured for the head 1 manufactured according to the embodiment. Dent amounts (due to deformation, gall, etc.) were measured for the face and the top portion of a completed product. In both cases, the dent amount does not exceed 0.1 mm and no corrugation is generated, so that it was confirmed that no problem occurs in durability. In addition, it was confirmed to be effective for increasing the strength.

Working Example 6

Figure 28:
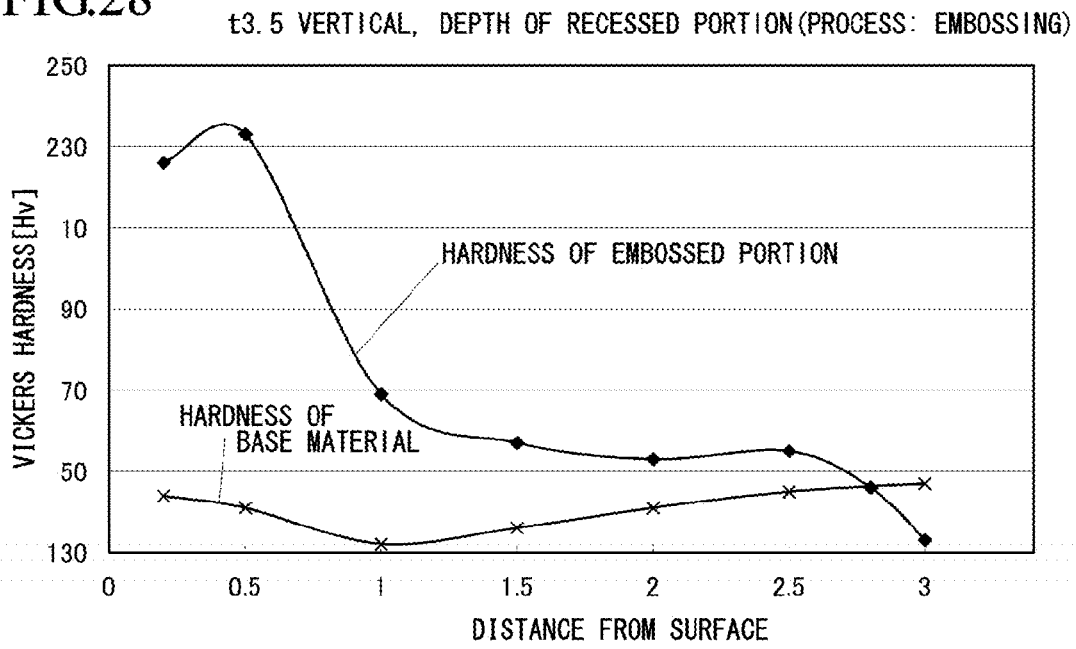
FIG. 28 is a chart of data illustrating hardness at position in the depth of a recessed portion in the case where the recessed portions are formed in a vertical direction on the face surface by forging.
Figure 29:
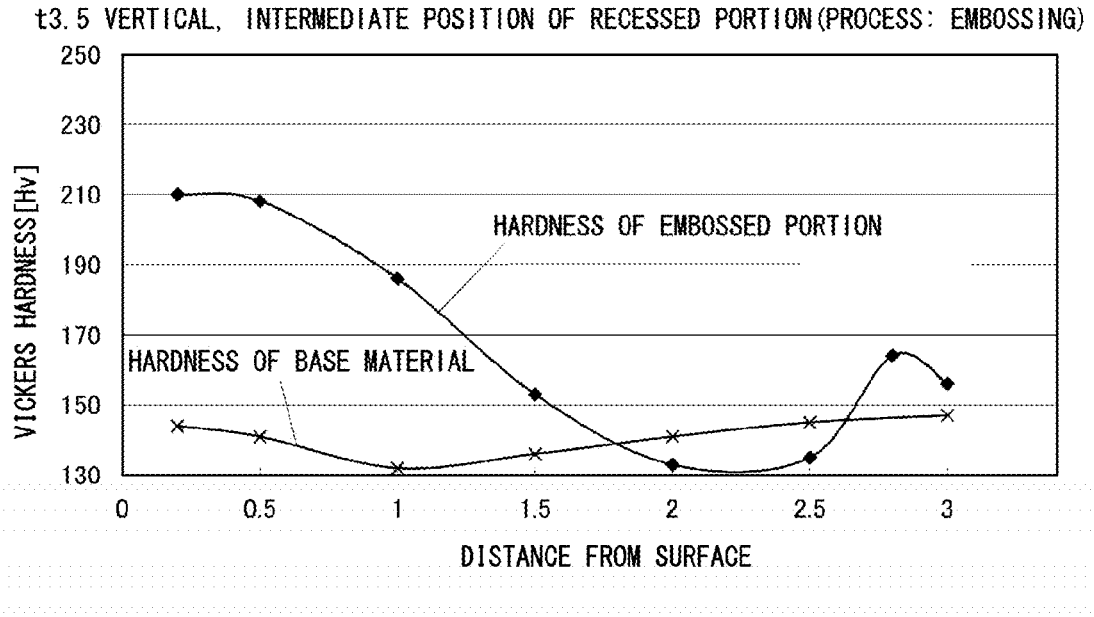
FIG. 29 is a chart of data illustrating hardness at intermediate position of a recessed portion in the case where the recessed portions are formed in a vertical direction on the face surface by forging.
Figure 30:
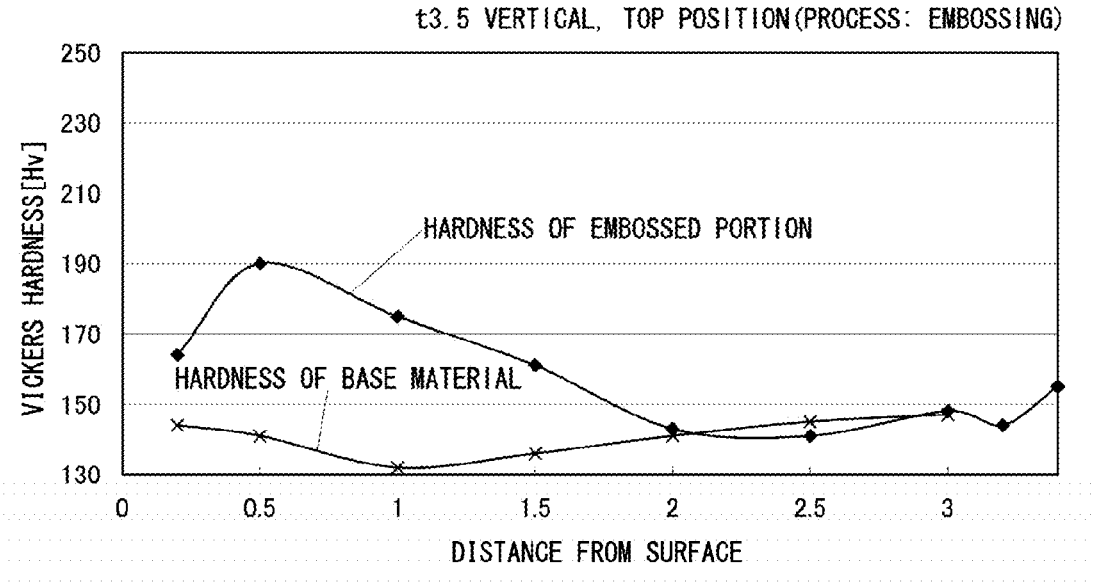
FIG. 30 is a chart of data illustrating hardness at top position in the case where the recessed portions are formed in a vertical direction on the face surface by forging.

FIGS. 28 to 30 are charts of data of the face surface which is a pressed type in which the projecting portion is formed in a vertical line shape and subjected to cold pressing. The face surface before cold press processing was formed on a flat surface by ordinary hot forging. In this case, recessed portions are formed in a linear manner on the face surface after press processing. In the example, the depth of the groove was 0.3 mm, the width thereof was 0.8 mm and the interval between the grooves was 3.7 mm. The thickness of the face was 3.5 mm. The cross-sectional shape corresponds to "2. vertical stripe" in FIG. 17. The measured hardness data at position lowered from the surface after performing cold pressing on the face surface were shown in graphs. FIG. 28 illustrates hardness data for the depth in the recessed portion, FIG. 29 illustrates hardness data for intermediate position (on the side face) in the recessed portion and FIG. 30 illustrates hardness data for top position.

Data of embossment hardness is for the process where the recessed portion is formed by using a linear shape. From the data, it was confirmed that hardness tends to increase to generate hardness difference with respect to the material depending on the depth position. It was confirmed as a result that the hardness is different depending on the forged portion of the portions of irregularity. Here, the hardness of the material was 144 Hv at the position of 0.2 mm.

Working Example 7

While description has been made on the premise of an iron golf club as to the above-mentioned working examples, the technical concept of the invention can also be applied to the face surface of a metal wood such as a driver. An α-β type titanium alloy round bar was hot forged to forma face portion of a driver head. Plurality of projecting portions having a hemisphere shape was formed on the rear surface thereof. The projecting portions are crushed by precision cold forging. The hardness was such as 307 Hv for the base material, 339 Hv for the projecting portion and 312 Hv for an intermediate portion between the projecting portions.

What is claimed is:

1. A method for manufacturing a golf club head which is manufactured by hot forging of low-carbon steel and in which a cavity is formed on the rear side of the face, the method comprising the steps of:

forming a plurality of portions of irregularity by press processing during the hot forging in order to form the hitting surface for hitting a ball on the face; and flattening the forged surface of the portions of irregularity after forming the portions of irregularity so as to fine crystal grains in the portions of irregularity and the areas therearound and to form fiber flows thereby increasing strength and hardness of the hitting surface, wherein the portions of irregularity have configuration, as viewed from the front side of the hitting surface, selected from plurality of circular shapes, linear band shapes and waved band shapes and each projecting portion of the portions of irregularity has a cross-sectional shape of a mountain-like triangle or a trapezoid.

2. A method for manufacturing a golf club head which is manufactured by hot forging of low-carbon steel and in which a cavity is formed on the rear side of the face, the method comprising the steps of:

forming a plurality of portions of irregularity by press processing during the hot forging in order to form the hitting surface for hitting a ball on the face; and flattening the forged surface of the portions of irregularity after forming the portions of irregularity so as to fine crystal grains in the portions of irregularity and the areas therearound and to form fiber flows thereby increasing strength and hardness of the hitting surface, wherein an iron golf club is manufactured by the method in which only projecting portions are crushed to be flat by cold forging after forming the portions of irregularity and thereafter the hitting face is subjected to machining process to smooth the surface by cutting processing, and score lines are formed on the hitting surface by processing by coining after the machining process.

3. The method for manufacturing a golf club head according to claim 1, wherein an iron golf club is manufactured by the method in which only projecting portions are crushed to be flat by cold forging after forming the portions of irregularity and thereafter the hitting face is subjected to machining process to smooth the surface by cutting processing, and score lines are formed on the hitting surface by processing by coining after the machining process.

* * * * *